US010170092B2

(12) United States Patent
Mayo et al.

(10) Patent No.: US 10,170,092 B2
(45) **Date of Patent: *Jan. 1, 2019**

(54) PEDAL BOARD CONNECTION SYSTEM FOR MUSICAL INSTRUMENTS

(71) Applicants: Gerard Mayo, Carina (AU); James Maida, San Diego, CA (US)

(72) Inventors: Gerard Mayo, Carina (AU); James Maida, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/973,425

(22) Filed: May 7, 2018

(65) Prior Publication Data

US 2018/0254030 A1 Sep. 6, 2018

Related U.S. Application Data

(63) Continuation-in-part of application No. 15/028,390, filed as application No. PCT/US2014/037353 on May 8, 2014, now Pat. No. 9,966,053.

(60) Provisional application No. 61/821,017, filed on May 8, 2013.

(51) Int. Cl.

| | |
|---|---|
| ***G10H 1/32*** | (2006.01) |
| ***G10H 1/34*** | (2006.01) |
| ***G10H 1/00*** | (2006.01) |

(52) U.S. Cl.

CPC ..... *G10H 1/348* (2013.01); *G10H 1/0008* (2013.01)

(58) Field of Classification Search

CPC .... G10H 1/348; G10H 1/0058; G10H 1/0066; G10H 1/0083; G10H 2230/085

USPC ..... 84/644

See application file for complete search history.

(56) References Cited

U.S. PATENT DOCUMENTS

| | | | | | |
|---|---|---|---|---|---|
| 5,244,415 | A * | 9/1993 | Marsilio | H01R 9/032 | 439/456 |
| 5,459,283 | A * | 10/1995 | Birdwell, Jr. | G10H 1/0058 | 84/737 |
| 5,576,507 | A * | 11/1996 | LaMarra | G10H 1/0066 | 84/645 |
| 6,215,055 | B1 * | 4/2001 | Saravis | G10H 1/348 | 84/422.1 |
| 6,800,810 | B1 * | 10/2004 | Page | H01B 11/20 | 174/102 R |
| 7,820,904 | B1 * | 10/2010 | Robling | G10H 3/186 | 84/600 |
| 8,710,370 | B2 * | 4/2014 | Heo | H01R 24/58 | 174/113 R |

* cited by examiner

*Primary Examiner* — Jeffrey Donels
(74) *Attorney, Agent, or Firm* — Jonathan A. Kidney; CKR Law LLP

(57) ABSTRACT

A musical instrument connection and extension system that easily and quickly connects back and front stage equipment, for example, musical amplification, effects pedals, rack mounted effects systems and components, wireless connectivity and power distribution for use with musical instruments.

20 Claims, 16 Drawing Sheets

FIG 4A
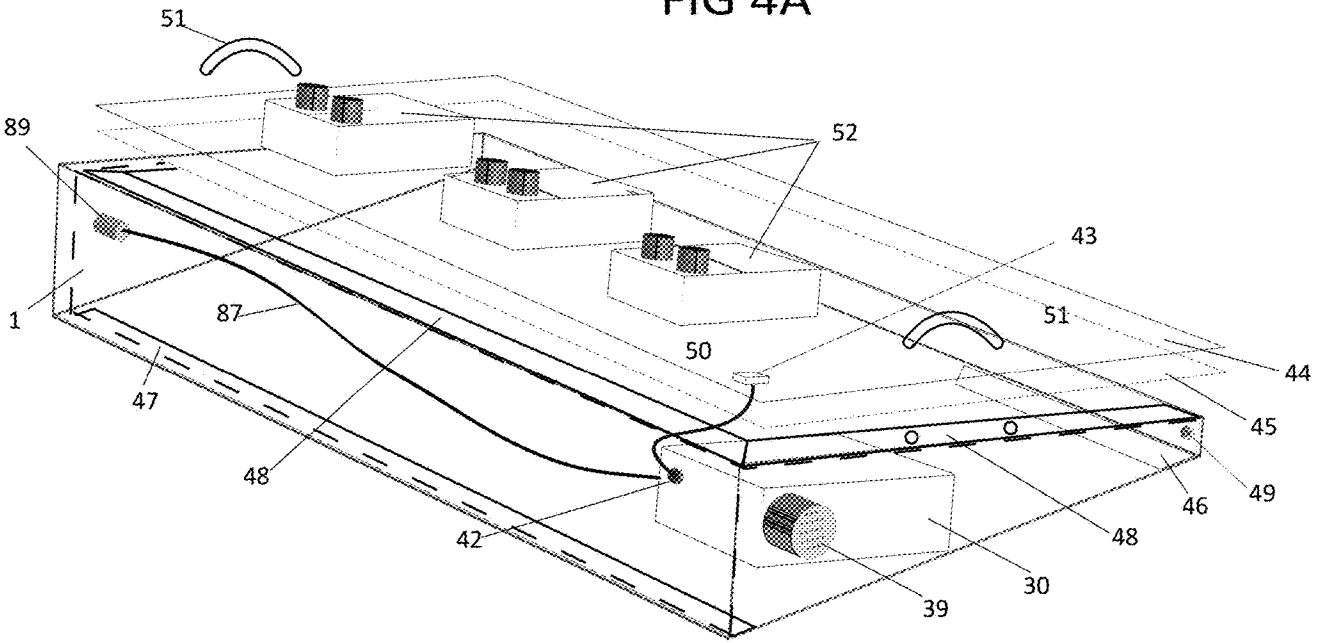
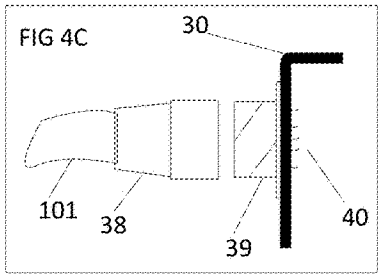
FIG 4C
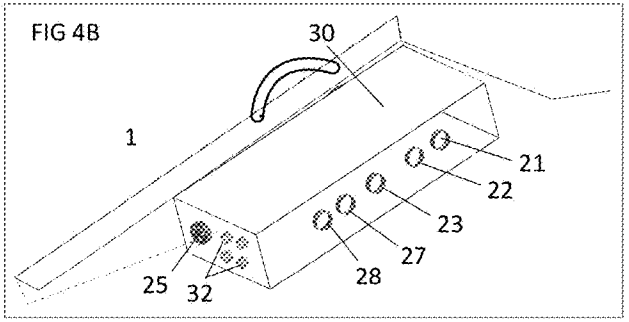
FIG 4B

PEDAL BOARD CONNECTION SYSTEM FOR MUSICAL INSTRUMENTS

CROSS-REFERENCE TO RELATED APPLICATIONS

This application claims the benefit of U.S. patent application Ser. No. 15/028,390, with filing date Apr. 8, 2016, issuing as U.S. Pat. No. 9,966,053 on May 8, 2018, which claims the benefit of International Application PCT/US2014/037353, filed May 8, 2014 claiming the benefit of Provisional Application No. 61/821,017, filed May 8, 2013, entitled Pedal Board and Connection System for Musical Instruments, and to Australian Patent Application No. 2013270633, filed Dec. 16, 2013, entitled Pedal Board & Pedal Board Station Connection System, the contents of which are incorporated herein by reference in their entirety.

FIELD OF THE INVENTION

Described herein are various embodiments relating to audio stage equipment, and more particularly to a device for connecting backstage equipment to front stage equipment through an aggregate connector.

BACKGROUND

It is common for electric guitarists, bass players, keyboardists, drummers that use electronic drum equipment, and other musicians to enhance the sound of their instruments with effects units. Effects units are electronic devices that alter the sound of musical instruments or other audio sources and can consist of analog or digital circuitry. While effects units are more frequently used with electric or electronic instruments, such units can also be used with acoustic instruments, drums, and vocals (among other examples). During a live performance, an effects unit may be added to the electrical "signal" path between a preamplifier ("preamp") and the instrument's amplifier; in the studio, the instrument or an auxiliary output of another sound-source (as examples) may be patched into the effect. Herein, the terms "stomp box", "pedal", "effects unit", "effects pedal", "foot-pedal", "switch" and "footswitch" are used synonymously.

Typically, these boxes contain only one or two effects and are controlled by one or more on-off foot switches (or sometimes by a foot-pedal). An "effects chain" or "signal chain" may be formed by connecting two or more stomp boxes. Musicians sometimes use a controller or effects management system, herein referred to as "effects controller", that allows for multiple effect chains to be created so that one or several chains can be engaged or disengaged by tapping a single switch.

To manage multiple pedals or foot controllers, musicians will often mount the pedals on a flat board or panel (referred to in the industry as a "pedal board") which may be included as part of the front stage equipment. By serving as a container, patch bay, and power supply distribution system, a pedal board provides a means to connect, hold, and organize the pedals.

Providing electrical power to multiple pedals may be problematic. Most musicians, especially in set ups that employ several pedals, often will require the use of several "wall-warts", which are usually plugged into a power board and can be positioned on or close to the pedal board. This can be problematic due to the main power source being located at the rear of most stages. Additionally, many other wires run between the back stage and the front stage are required due to the multiple connections need for instrument connection, digital communication, amplifier footswitches, effects loops, and the like. Not only does this present a dangerous trip hazard, but it becomes very time consuming for system setup and teardown. Thus, there is a need for a single, safe cable that quickly joins the back stage equipment to the front stage effects, while neatly grouping the various input and output sockets.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

An embodiment takes the form of a device for connecting musical instruments. The device includes: a housing for supporting (i) an aggregate wiring connector having a plurality of electrical conductors, (ii) a plurality of monophonic electrical signal connectors, and (iii) at least one output power connector. The device further includes a wiring harness interconnecting ones of the plurality of electrical conductors of the aggregate wiring connector to ones of the plurality of monophonic signal connectors. The device also includes and at least one supply voltage conditioning circuit connected to at least one conductor of the plurality of electrical conductors for receiving a supply voltage and having a regulated voltage output connected to the at least one output power connector.

An embodiment takes the form of a device that includes: a housing for supporting (i) an aggregate wiring connector having a plurality of electrical conductors, (ii) a plurality of monophonic electrical signal connectors, and (iii) at least one output power connector. The device also includes a wiring harness interconnecting ones of the plurality of conductors of the aggregate wiring connector to ones of the plurality of monophonic signal connectors and a multiple wire cable having a front end and a back end. The front end terminates into a front cable connector adapted for mating with the aggregate wiring connector and the back end terminates into a plurality of electrical connectors, thereby extending the plurality of conductors of the aggregate wiring connector beyond the housing when the front cable connector is mated to the aggregate wiring connector. The device further includes at least one supply voltage conditioning circuit housed within one of the plurality of electrical connectors at the cable back end. The circuit is adapted for receiving a supply voltage and includes a regulated voltage output connected to at least one of the aggregate wiring connector conductors and connected to the at least one output power connector.

An embodiment takes the form of a method that includes receiving one or more monophonic audio signals from respective monophonic-audio-signal connectors via respective monophonic-audio-signal conductors. The method further includes aggregating the one or more monophonic audio signals into respective wire groups of a multi-wire cable and providing the aggregated monophonic audio signals to a back station via the multi-wire cable. The method further includes receiving at least one supply voltage from the back station via the multi-wire cable and regulating the at least one supply voltage via a conditioning circuit. The method also includes outputting the regulated supply voltage to respective output power connectors.

BRIEF DESCRIPTION OF DRAWINGS

FIGS. 4A, 4B, and 4C are perspective views of an embodiment device for connecting musical instruments.

DETAILED DESCRIPTION

In the following detailed descriptions of various embodiments, reference is made to the accompanying drawings that form a part hereof, and in which is shown, by way of illustration, specific embodiments that may be practiced. It is to be understood that other embodiments may be utilized and structural changes may be made without departing from the scope of the present disclosure.

Figure 1:
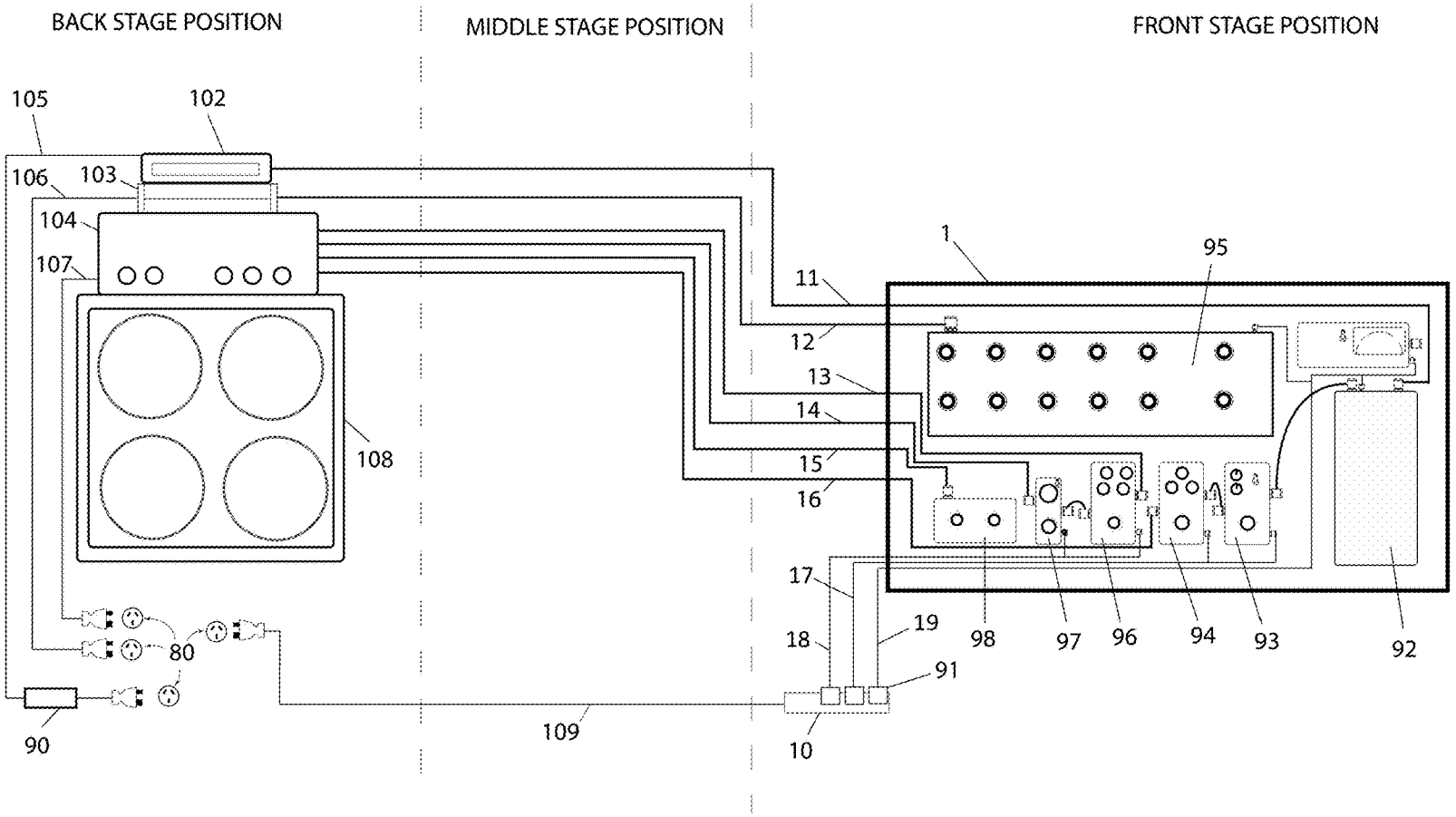
FIG. 1 is a system diagram of an embodiment device for connecting musical instruments.

FIG. 1 is a system diagram of an embodiment device. FIG. 1 illustrates the multitude of individual cable connections required to set up an individual musician's back-stage equipment to the front-stage electronics. A typical musicians' setup is shown where an amplifier 104 (which can include one or more speaker cabinets 108), an effects rack 103, and a wireless receiver 102 are located in the back-stage position. In addition, a configuration of a typical pedal board 1 is shown being located at the front stage position. Numerous connections may be required between the pedal board 1 and the back stage equipment in order for the musician's instrument to operate and function properly.

Generally speaking, power is located on most performance stages in the back stage position, which is close to where most of the musical instrument amplifiers 104 and effects rack 103 equipment are located. An amplifier power lead 107 and an effects rack power lead 106 are plugged into a main power source 80. Depending on the country, the main power source 80 can be either 120 VAC 60 Hz or 240 VAC 50 Hz, though different AC or DC voltages may be supplied. A wireless receiver power lead 105 may be connected to an AC/DC converter 90 which may plug into the main power source 80.

Normally, powering the effects pedals 93, 94, 96, and 97 on a pedal board 1 requires two or three AC/DC transformers 91, which may also be referred to as "wall-warts". These may be plugged into a power strip 10, which is also connected to main power 80. Sometimes if the wall-warts 91 are located back stage, the musician would need to run wall-wart leads 17,18,19 from the back stage to the front stage, thereby increasing the number of cables and connections. Alternatively, these wall-warts 91 and power strips 10 are instead positioned at the front stage position, as illustrated. In this situation, the wall-warts 91 require connection to the main power source 80 by using an AC power cord 109, which may be used to connect the main power source 80 either to the power strip 10 or to the wall-warts 91 directly. If a musician's pedal board 1 requires multiple wall-warts 91 and does not use the power strip 10, multiple AC power cord leads 109 would be required. Running one or more AC power cord leads 109 is not only undesirable given the cost and complexity, but can also present a safety hazard such as from tripping, or electric shock.

At the front stage position is the pedal board 1 which may contain various devices including volume pedal 92, effects pedals 93, 94, 96, and 97, effects footswitch 98, and a musical instrument digital interface (hereinafter referred to as MIDI) foot controller 95, just to name a few. MIDI is a standard that is maintained by the MIDI Manufacturers Association (MMA). To connect the pedal board 1 for use, the instrument in-signal lead 11 may be connected from the volume pedal 92 to the wireless receiver 102. In the event the musician is not using a wireless receiver 102, the instrument in-signal lead 11 may be supplied directly from the musician's instrument (not shown). From the effects rack 103, the MIDI effects cable 12 may be connected to the MIDI foot controller 95. The effects send-signal lead 14 and effects return-signal lead 13 may be used to connect the amplifier 104 to effects pedals 96 and 97. The musician may use effects footswitch 98 to select between a distorted and clean sound. To accomplish this, amplifier 104 interfaces with the footswitch 98 by using the amplifier footswitch lead 15. Signal lead 16 is the connection to the amplifier 104 which is typically connected to the first pedal in the effects chain, which may be effects pedal 94. Power cables/wall-wart leads 17,18,19 may be connected to provide power to the effects pedal 92, 93,94, effects loop pedals 96, 97, MIDI foot controller 95, footswitch 98, and any other devices that may be located on the pedal board that require power to operate.

Most effects pedals and footswitches require very little power to operate, and on average, draw a current in the range approximately between 150 mA to 250 mA at approximately 9 Volts DC. Using a 9 Volt DC, 1.5 amp wall-wart and sequentially chaining the footswitch cables, one wall-wart may provide enough power for up to 5 pedals without presenting any power or noise issues.

In an embodiment, the number of connections from the back stage to front stage requires six (6) for signal and effects, and either one (1) for power, if a power strip 10 is employed at the front stage, or more than one if the wall-warts 91 are located back-stage and multiple DC power wires are required to power the pedal board 1. Therefore, a minimum of at least seven (7) individual cables may be required.

Figure 2A:
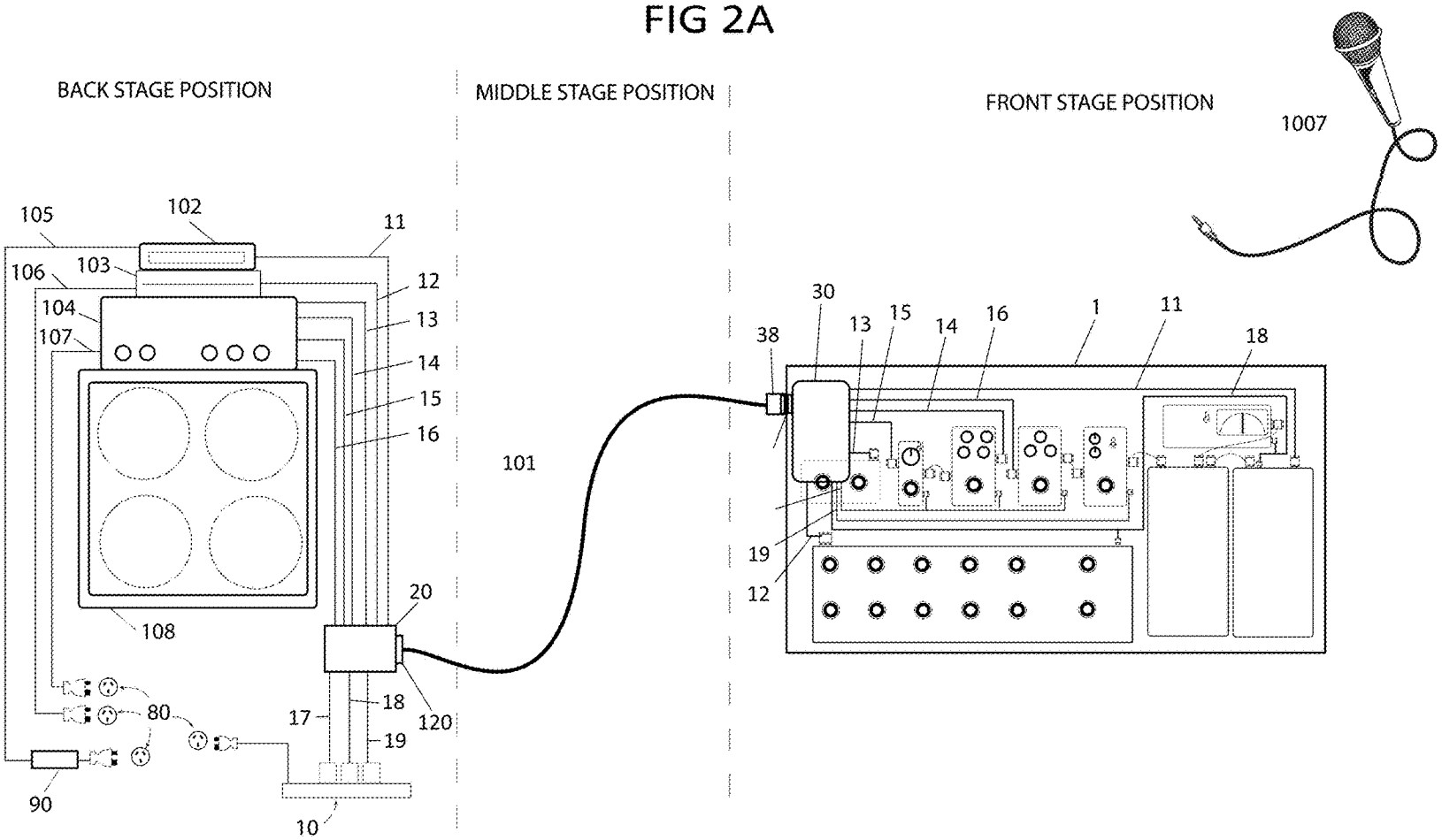
FIGS. 2A and 2B are system diagrams of an embodiment device for connecting musical instruments.
Figure 2B:
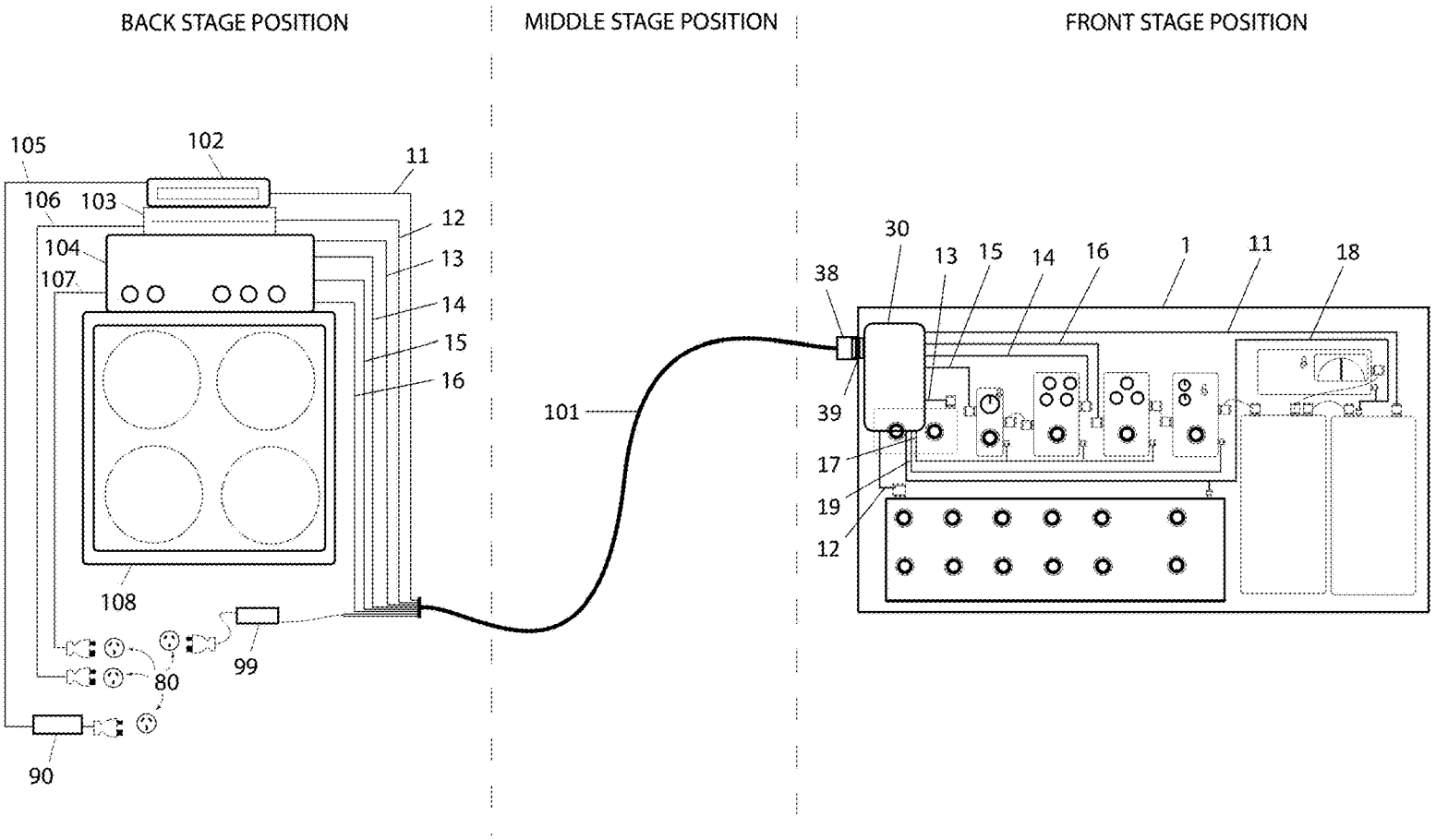

FIGS. 2A and 2B are system diagrams of another embodiment device. Similar to FIG. 1, the connections between the various devices are shown. However, FIGS. 2A and 2B differ in that all of the middle stage position conductors have been replaced by a cable 101. At the back stage position, a back station 20 may be positioned close to the amplifier 104, effects rack 103, and wireless receiver 102 so this equipment may be more easily connected to the back station 20. As previously described in FIG. 1, the amplifier's power lead 107 and effects rack's power lead 106 may be plugged into the main power source 80. The wireless receiver's lead 105 is connected to an AC/DC converter 90, which may plug into the main power source 80. Power may be supplied via an AC/DC transformer 99 that terminates on the power conditioning circuit board 60,61 (see FIG. 6) located within the front station 30. To connect the various components that comprise the back stage equipment to the back station 20, the following connections may be used: instrument in-signal lead 11, effects loop send signal lead 14, effects loop return signal lead 13, and the amplifier instrument in-signal lead 16.

Any one or more of the signal leads 11-16 in, for example, FIG. 2A, or other connections described herein, may convey a microphone signal from a wired or wireless microphone 1007. Further, while conventional music-related signals are typically analog in form, it is understood that digital signals may be utilized according to implementation preference. Therefore, digital equivalents can be devised and are understood to be within the spirit and scope of this disclosure.

Leads 11,13,14,16 may all require a standard 6.5 mm mono plug and cable (not shown) to mate with a corresponding standard 6.5 mm mono socket (not shown) mounted on the back station 20. The amplifier footswitch signal lead 15 may require a stereo 6.5 mm plug and cable to mate with the equivalent 6.5 mm stereo socket mounted on the Back Station 20. The MIDI effects cable 12 may require a standard MIDI plug and cable (not shown) to mate with a corresponding MIDI socket (not shown) mounted on the back station 20. Various power transformers and wall-warts 17,18,19 may use standard 2.1 mm male plugs and cables (not shown) that typically are supplied with wall-warts, and mate with corresponding sockets (not shown) mounted on the back station 20.

The back station 20 may contain at least one polarity selector switch (not shown) for selecting the polarity of one or more amplifier footswitches such as 93-98 because various manufacturers terminate the active and ground signal wires into a connector, or audio plug, in different combinations. Switch selection may reverse the active and ground signals of the 6.5 mm mono or stereo plug to a configuration that is opposite. The switch may be set by the musician depending on the type of amplifier footswitch 93-98 used.

In an embodiment, the front station 30 may be located at the front stage position and may be installed inside and an integral part of the pedal board 1. Although similar in design to the back station 20, the front station 30 provides all of the same connections, except the difference being the connections are made to the front stage electronics as opposed to the back stage equipment. To connect the various components that comprise the front stage equipment to the front station 30, the following connections are used: the instrument in-signal lead 11, effects loop send signal lead 14, effects loop return signal lead 13, and the amplifier instrument in-signal lead 16. Leads 11,13,14,16 may all require a standard 6.5 mm mono plug and cable (not shown) that mates with a corresponding 6.5 mm mono socket that is mounted on the front station 30. The amplifier footswitch signal lead 15 may require a standard stereo 6.5 mm plug and cable (not shown) that mates with a corresponding 6.5 mm stereo socket (not shown) that is mounted on the Front Station 30. The MIDI effects cable 12 may require a standard MIDI plug and cable (not shown) to mate with a corresponding standard MIDI socket (not shown) mounted on the front station 30. Using standard 2.1 mm power plugs and cables (not shown) that are typically supplied with wall-warts, DC power leads 17,18,19 may connect to corresponding 2.1 mm power sockets (not shown) mounted in the front stage position or back stage position. In an embodiment, a single power lead with transformer 99 may be plugged into main power 80. Advantageously, there is no requirement to have the DC Power Leads 17,18,19 coming from the various wall-warts when supplying power to the back station 20. Power to the back station 20 may be an AC voltage such as 120 VAC/60 Hz, or a stepped-down AC voltage.

In an embodiment, connection may be made between the back station 20 and front station 30 using a multi-conductor cable 101, which can be embodied in several ways. The multi-conductor cable 101 may be manufactured with a multi-pin connector 38 on one or both ends of the cable 101. Alternatively, a cable gland connection 120 may be disposed on one end or on both ends of the cable 101. The multi-conductor cable 101 may use a cable gland connection 120 that is permanently connected to the back station 20 and an aggregate connector 39 on the end that interfaces with the front station 30. In an embodiment, the multi-pin connector may be comprised of a plug disposed on the cable 101 end which may connect or mate with the aggregate connector 39 on the front station 30 or the back station 20.

In an embodiment, the front station 30 may be enclosed within the pedal board 1, the aggregate connector 39 may protrude through a cut-out on the side of the pedal board 1 that allows mating with the plug 38. In addition, screw holes (not shown) may be provided on the same side of the pedal board 1 to allow for insertion of mounting screws (not shown) that will fasten both the aggregate connector 39 and the front station 30 to the pedal board 1. The front station 30, although it may be incorporated within and housed in the pedal board 1, may also be configured to be used on any existing pedal board, such as in a do-it-yourself modification. When the plug 38 is mated with the aggregate connector 39, all the back stage equipment power and signal connections from the back station 20 may be correctly connected to the corresponding power and signal connections required by the effects units 93-98 on the pedal board 1. All of the effects 93-98 connections may remain permanently connected because they are plugged into the front station 30, thus allowing the setup and tear-down of the front stage to be made quickly.

The multi-conductor cable 101 may contain individually shielded wire pairs, wire-triplets, power wires, grounds, shielding, and so forth, and may also be configured to employ different quantities of power and signal combinations. The wires may be adapted for providing functions such as supply voltage, supply voltage return, monophonic sound, monophonic sound return, stereophonic sound, stereophonic sound return, receive, digital transmit, signal ground, and power ground. Additionally, the cable 101 may be terminable with multi-pin connectors with pin quantities of 19, 24, 36, and so forth, as an example. In this manner, the back station 20 and front station 30 may accommodate a multitude of different power and signal requirements which may be custom tailored for addressing the specific needs of the musician and instruments requiring connections between the front stage and back stage.

Figure 3A:
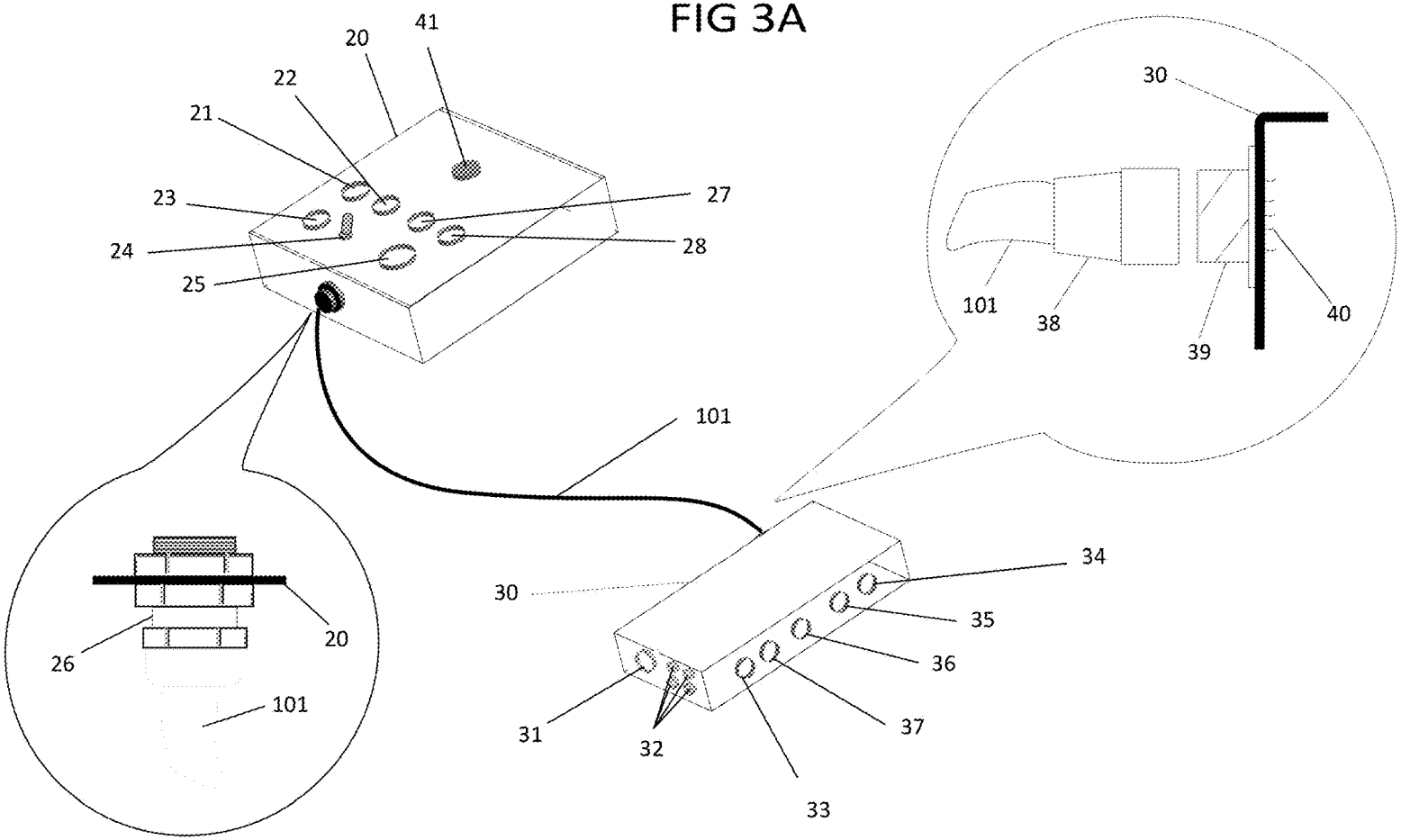
FIGS. 3A, 3B, 3C, 3D, 3E, and 3F are perspective views of various embodiment devices for connecting musical instruments.

FIG. 3A is perspective view of an embodiment device. An embodiment may comprise the back station 20 and the front station 30 with a cable 101 joining them. Depending on the number of wires within the multi-conductor cable 101, the diameter may vary and the pin-count and dimensional size of a corresponding multi-pin connector may also vary accordingly. As depicted in FIG. 4C and in the inset of FIG. 3A, the front stage end of the cable 101 may terminate into a multi-pin connector 38. Cable connector 38 may be a bayonet, quick-disconnect, threaded, or the like and may terminate to a corresponding aggregate connector 39 mounted on the front station 30. The aggregate connector 39 may have solder cups, wires, or leads 40 which may join to other equipment or connectors in the front station 30.

The back stage end of the cable 101 may or may not terminate into a connector. In an embodiment, the cable 101 end on the back stage end may have a cable gland 26 to guide and protect entry of the cable 101 into the back stage station 20. In another embodiment, the back stage end of the cable 101 may terminate into a multi-pin connector similar to the front stage end of the cable 101.

The back station 20 may have an enclosure that supports various connectors, switches, LEDs, dials, displays, and so forth. Power input sockets 29 (not shown), located on the reverse side, may be standard 2.1 mm DC connector sockets and may be any number to accommodate a mix and range of power from 9-24 VDC and up to 5 Amps. In addition, the back station 20 may also have mono audio signal input sockets 21,22,27,28 which may carry mono signals from the instrument that originate either at the instrument or a wireless receiver 102. Mono signals may also originate from the amplifier instrument, from the effects send, and from the effects return. The sockets 21,22,27,28 may be standard 6.5 mm mono audio connectors. Furthermore, the back station 20 may also have stereo audio signal input sockets 23, which may carry stereo signals from the amplifier footswitch 98. The sockets 23 may be standard 6.5 mm stereo audio connectors. One or more polarity switches 24 may be provided for the audio signal sockets 21,22,23,27,28, and may have one or more throws depending on the number of sockets. For example, a single-pull, quadruple throw (SPQT) switch may be used for four mono sockets to simultaneously switch the polarity for all sockets. Other switches such as rocker, push-button, toggle, momentary, or the like may be used. Also, the back station 20 may have at least one musical instrument digital interface (MIDI) connector 25 which may accept signals from the MIDI foot controller 95. The MIDI connector may be a standard MIDI connector such as a 5-pin or 7-pin for example. In an embodiment, at least one LED indicator 41 may be used to show that power is on/off, the polarity of an audio socket, whether an instrument is plugged in, and so forth.

The front station 30 may have an enclosure that supports various connectors, switches, LEDs, dials, displays, and so forth. Power output sockets 32 may be standard 2.1 mm DC connector sockets and may be any number to accommodate a mix and range of power from approximately 9-24 VDC and up to 5 Amps. In addition, the front station 30 may also have mono audio signal input sockets 33,34,35,37 which may carry mono signals from the instrument that originate either at the instrument or a wireless receiver 102. Mono signals may also originate from the amplifier instrument, from the effects send, and from the effects return. The sockets 33,34,35,37 may be standard 6.5 mm mono audio connectors. Furthermore, the front station 30 may also have stereo audio signal input sockets 36, which may carry stereo signals from the amplifier footswitch 98. The sockets 33,34, 35,37 may be standard 6.5 mm stereo audio connectors. One or more polarity switches (not shown) may be provided for the audio signal sockets 33,34,35,36,37, and may have one or more throws depending on the number of sockets. For example, a single-pull, quadruple throw (SPQT) switch may be used for four mono sockets to simultaneously switch the polarity for all sockets. Other switches such as rocker, push-button, toggle, momentary, or the like may be used. Also, the front station 30 may have at least one musical instrument digital interface (MIDI) connector 31 which may accept signals from the MIDI foot controller 95. The MIDI connector may be a standard 5-pin MIDI connector. In an embodiment, at least one LED indicator 42, located on the reverse side, may be used to show that power is on/off, the polarity of an audio socket, whether an instrument is plugged in, and so forth. In another embodiment, the LED indicator 42 may be a low power input socket such as a universal serial bus (USB).

Figure 3B:
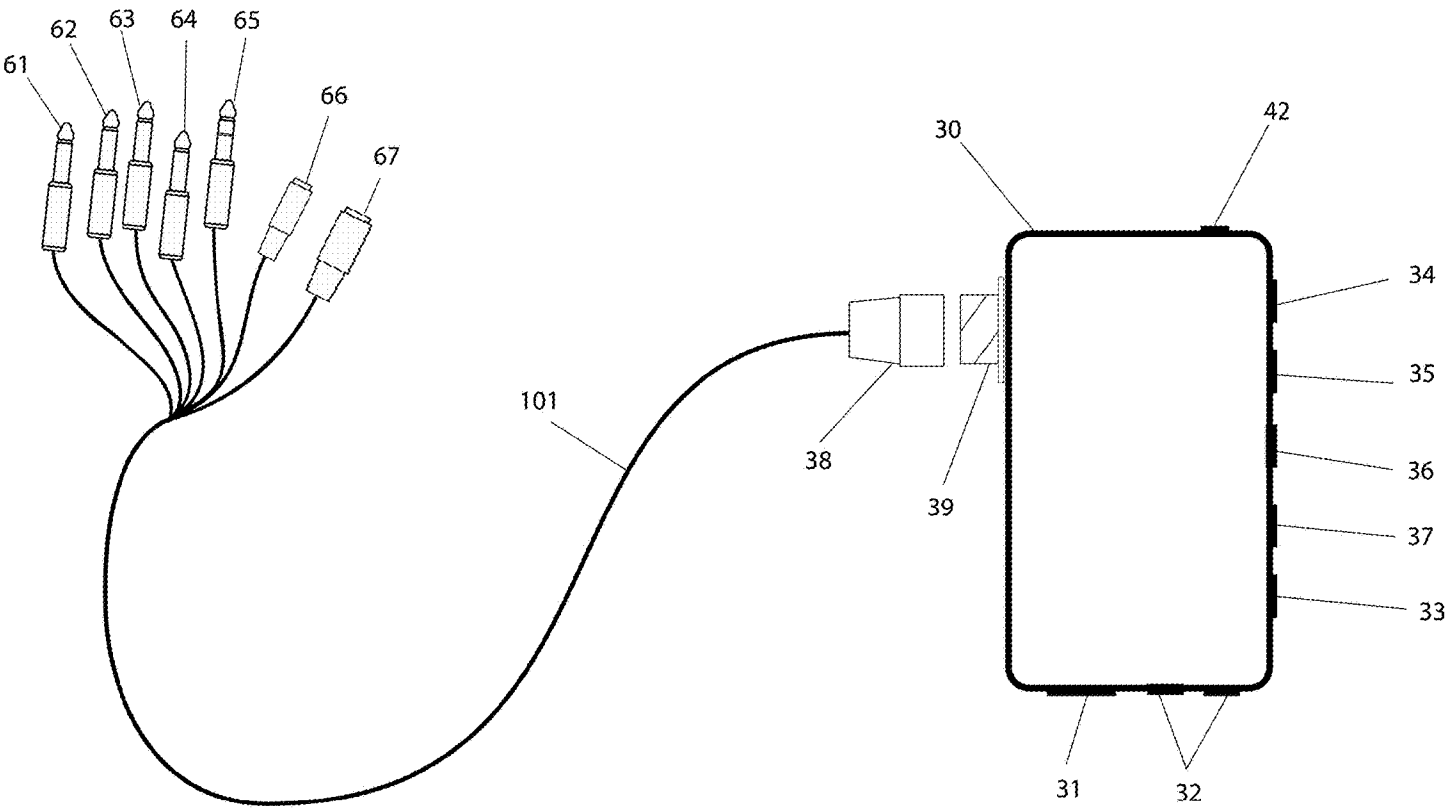

FIG. 3B is a perspective view of an embodiment device. As shown, FIG. 3B illustrates another embodiment of the cable 101 and different configuration which may be practiced without other previously disclosed components, such as the back station 20. In an embodiment, the back station may be replaced by plugs 61-67, which include individual signal plugs 61-65, power plug 66, and MIDI plug 67. These plugs 61-67 may also correspond to the inputs contained in front station 30. The plugs 61-65 may carry mono signals or stereo signals. Mono signals may originate from either an instrument or a wireless receiver 102. Mono signals may also originate from an amplifier instrument, from an effects send, and from an effects return. Stereo signals may originate from the amplifier footswitch 98. The plugs 61-65 may be standard 6.5 mm audio connectors. Additionally, the plugs 61-67 may comprise at least one musical instrument digital interface (MIDI) connector 67 which may accept signals from the MIDI foot controller 95. The MIDI connector may be a standard 5-pin or 7-pin MIDI connector for example.

In another embodiment, each plug 61-67 may be installed on an individual cable (herein referred to individually as a cable extension or collectively as cable extensions) of predetermined length, such as 2 feet: a length to easily allow inserted all of the plugs 61-67 into the back stage equipment and/or power source. Note, depending on the number of wires within the cable 101, the quantity of cable extensions and accompanying plugs and/or sockets may vary accordingly. Power may be supplied from an external wall-wart (not shown) that connects to at least one power socket 66. Alternatively, power may be supplied to a power socket 66 and then be conditioned and/or regulated within the power socket 66 prior to delivering to the front station 30. In this manner, a voltage regulator or power conditioner may not be required within the front station 30. Voltage supplied to the power socket 66 may be approximately 24 VDC and up to 5 Amps. Other voltages and current may be supplied through additional power sockets.

Figure 3C:
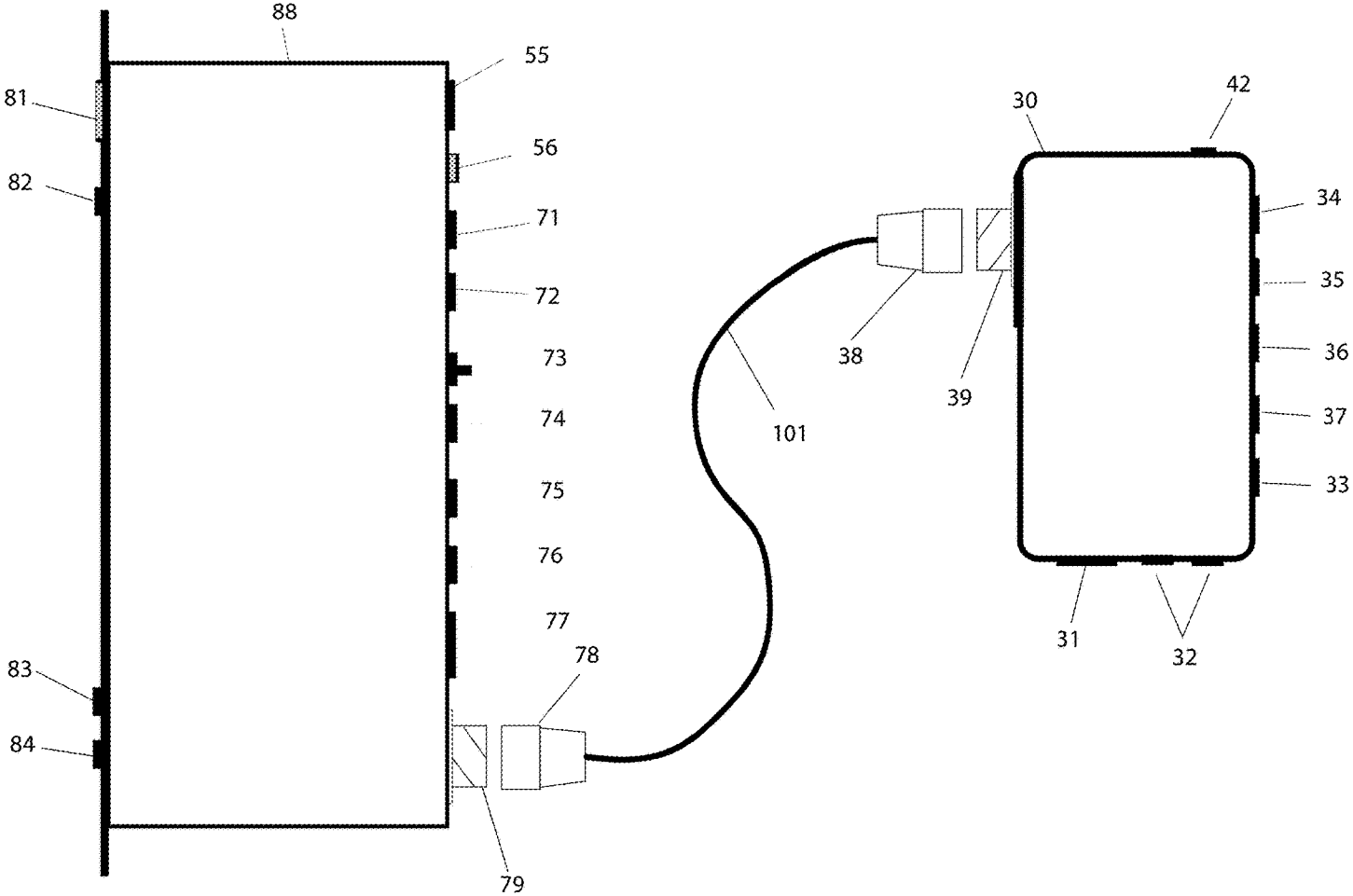

FIG. 3C is a top view of an embodiment device. The back station 88 may be a rack mount enclosure. Connection between the front station 30 and the back station 88 may be a cable 101 with multi-pin cable connectors 38,78. The front cable connector 38 may be identical to the back cable connector 78 in order to simplify installation of the cable 101. The back station 88 may have an aggregate connector 79 which may be similar to the aggregate connector 39 on the front station 30. In an embodiment, power input socket 55 and all signal input sockets 71-77 may be positioned at the rear of the back station 88 for easier connection with other rack mounted equipment. Back stage connections, with the exception of the amplifier cable 16 (see FIG. 2), may remain permanently connected to the back station 88. The front panel of the back station 88 may comprise a power switch 81 and a power status LED indicator 82. Located elsewhere on the back station 88 front panel may be various LED indicator lamps 83,84 that illuminate upon mating the aggregate connector 79 to the amplifier signal input 71, which may have connectivity from the amplifier cable 16 (not shown). Power may be supplied directly from the main power source 80 to power input socket 55. Adjacent to, or incorporated within, the power input socket 55 may be a fuse 56 to prevent power surges from damaging equipment connected to the back station 88.

Figure 3D:
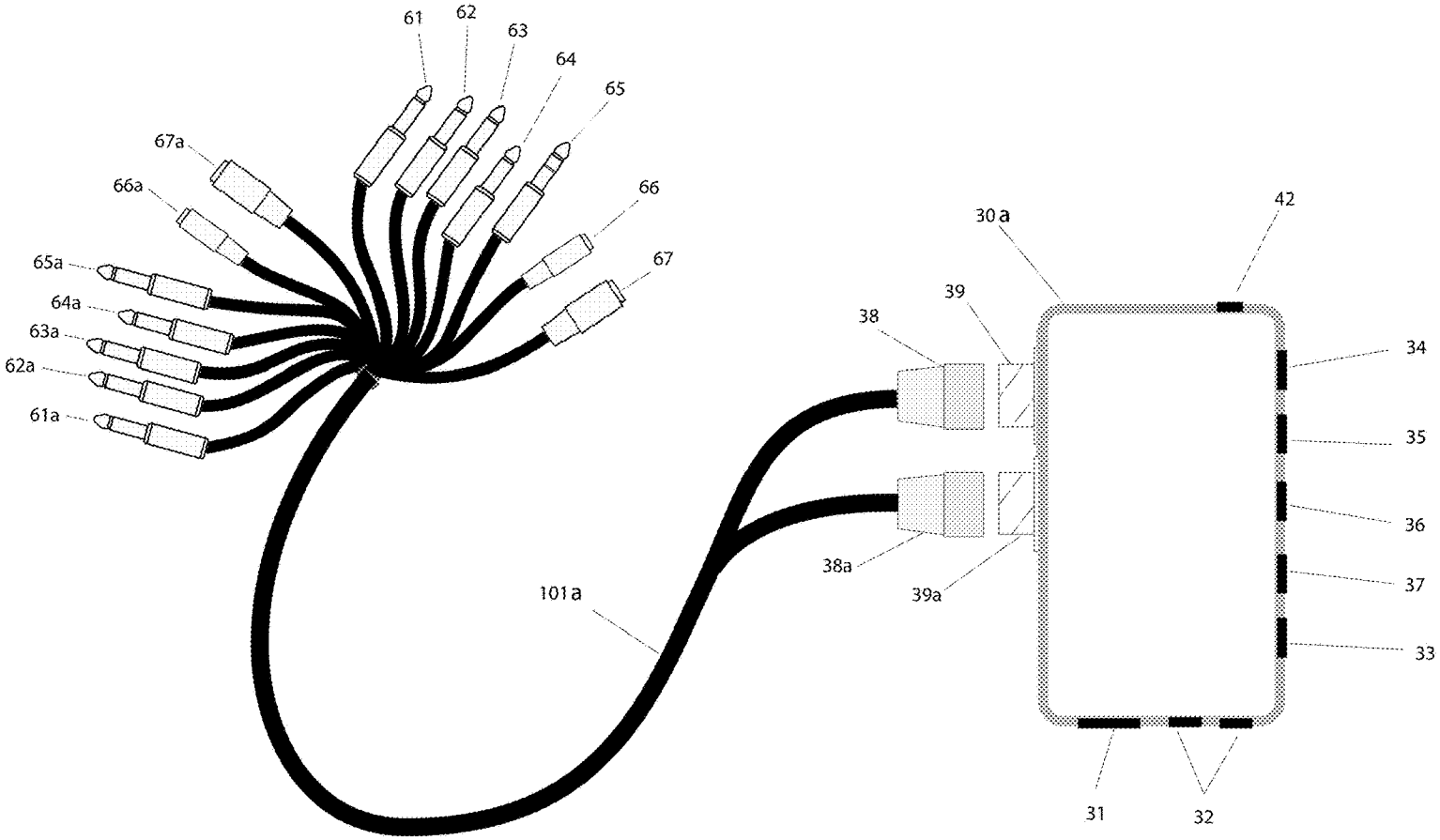

FIG. 3D is a top view of a modification of the embodiment shown in FIG. 3B. Specifically, exemplary cable 101*a* is fitted with and additional set of end plugs 61*a*-67*a* that correspond to multi-pin cable connectors 38*a*, which mate with aggregate connector 39*a* of modified front station 30*a*. The additional plugs and connectors enable the disclosed embodiments to utilize a larger set of signals and/or power, as desired. Given the teachings provided herein, it is understood that it is within the purview of one of ordinary skill in the art to make the appropriate internal and external modifications to front station 30*a* (and back station 88*a*—not shown) to provide the desired signals and connections. Also, as demonstrated herein, additional plugs, either individually or in sets, may be added to the exemplary cable 101*a* to further increase the number of signals and/or power channels.

Figure 3E:
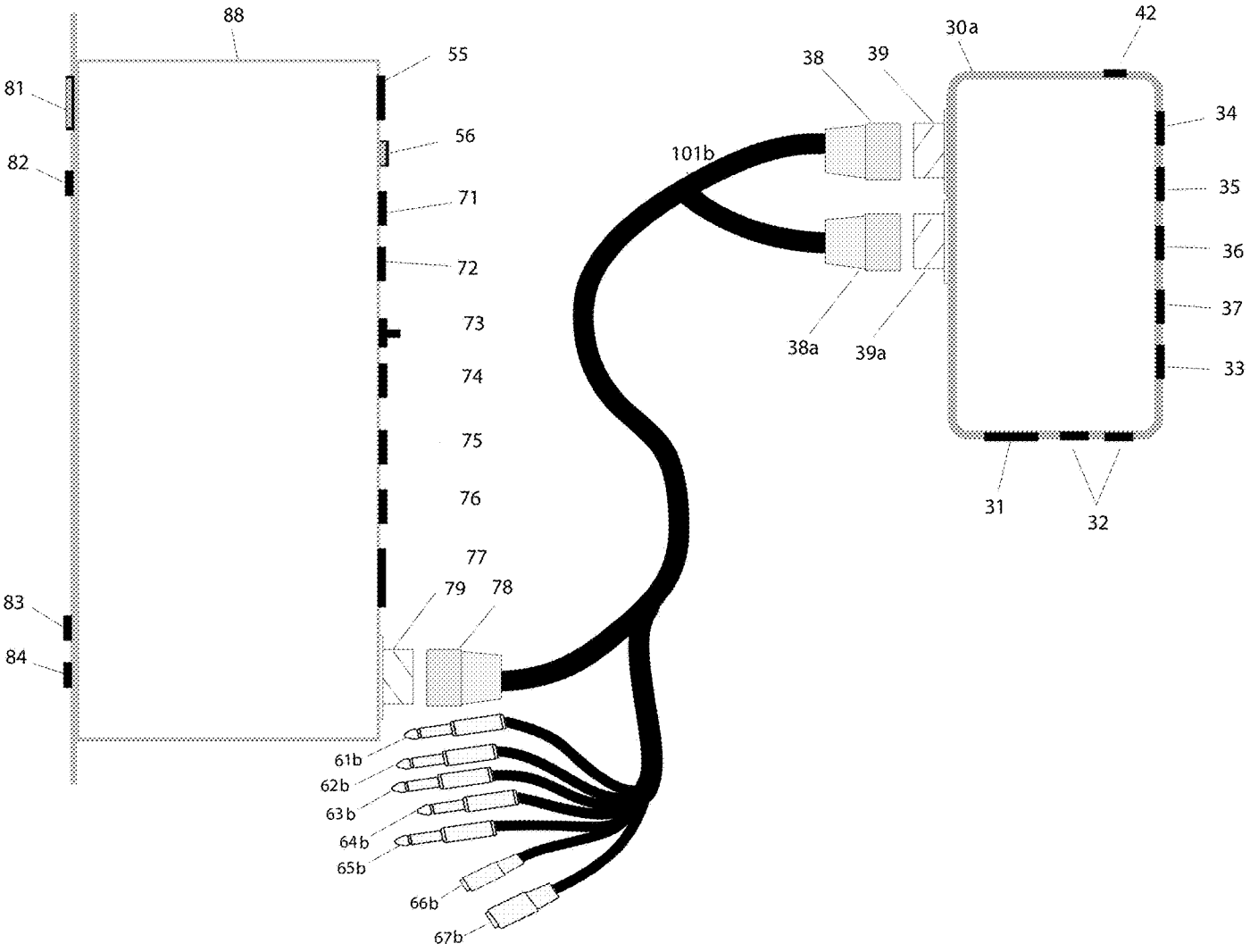

FIG. 3E is a top view of a modification of the embodiment shown in FIGS. 3C and 3D, wherein a plurality of cable connectors 38, 38*a* terminate one side of exemplary cable 101*b* to front station 30*a* with accompanying aggregate connectors 39, 39*a*. The opposite side of cable 101*b* is terminated with cable connector 78 and end plugs 61*b*-67*b*, to mate with back station 88's aggregate connector 79 and with respective instruments, devices, etc. that mate with end plugs 61*b*-67*b*. This embodiment allows for several sets of connection types and helps to accommodate situations where a large number of connections (e.g., instruments, etc.) are needed or "banks" of instruments and equipment are connected.

Figure 3F:
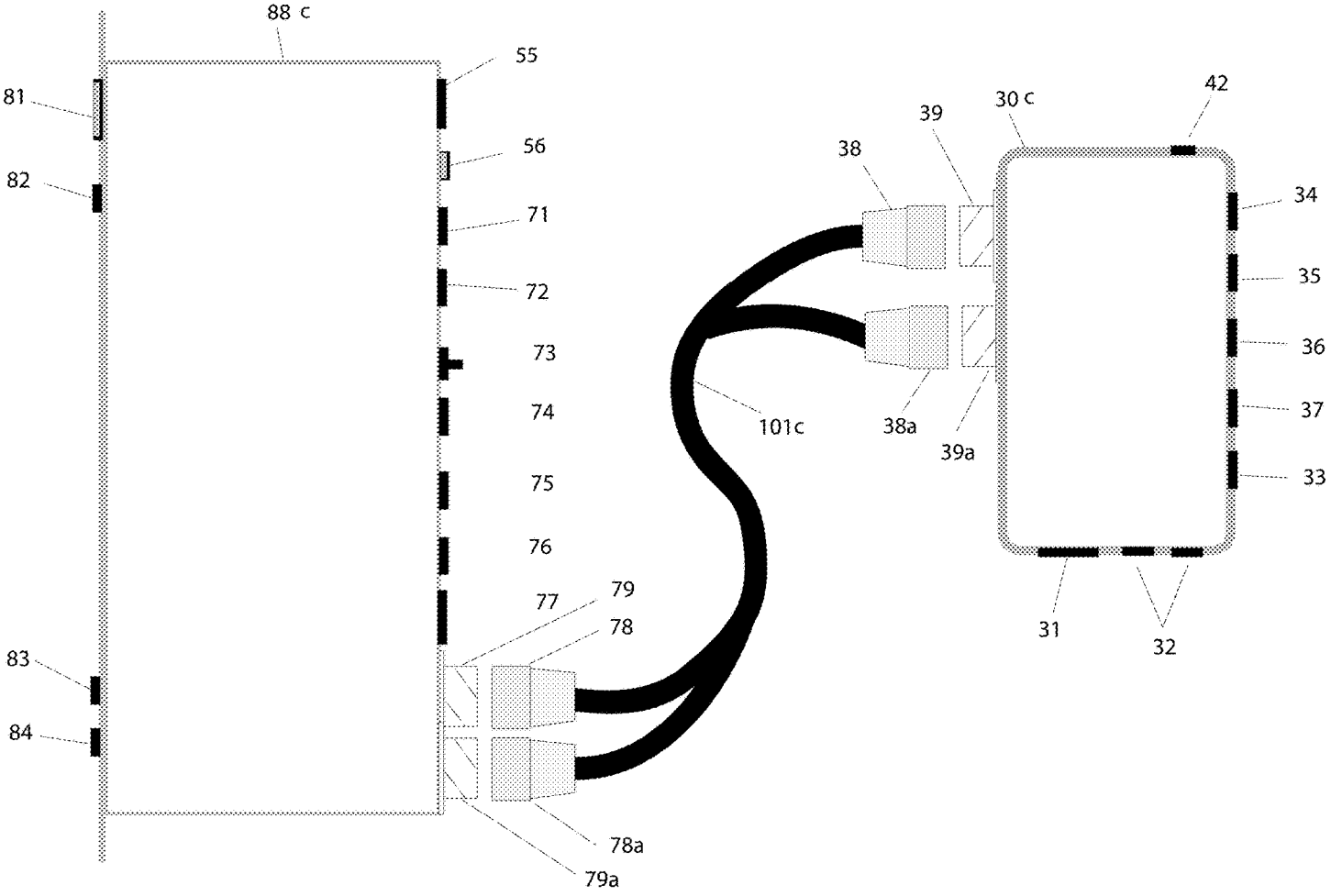

FIG. 3F is a top view of another modification of the previous embodiments, wherein cable 101*c* is terminated with sets of cable connectors 38, 38*a* and 78, 78*a*. The respective cable connectors mate to aggregate connectors 39, 39*a* and 78, 78*a* of front station 30*a* and back station 88*c*, respectively. Therefore, additional "sets" of cable and aggregate connectors may be implemented to provide "banks" of connections, if so desired.

As should be apparent from the above illustrations, several variations and modifications can be made by one of ordinary skill in the art, and therefore they are understood to be within the spirit and scope of this disclosure. FIG. 4A is a perspective view of an embodiment device. The device is illustrated with transparent walls to simplify viewing internals of a pedal board 1. The front station 30 may be mounted inside the pedal board 1 with the aggregate connector 39 protruding through the pedal board 1 wall. In another embodiment, the front station 30 may be attached to the outside of the pedal board 1. The pedal board 1 may be constructed out of a single piece of metal, which may be aluminum sheeting 2.5 mm thick. The sheeting may be cut by laser, shears, water jet, saw, and so forth. Once cut to size, the sheet may be bent at 6 places (identified by the dashed line) using a brake, hydraulic press, or the like. Each bend adds strength to the overall forming of the pedal board 1 as well as providing attachment locations for the top surface 44 and handles 51. The front base return edge 46 and the side top edges 48 are each formed from the single piece of metal. In an embodiment, the top surface 44 may comprise a carpet underlay, similar to that used for vehicle sound absorption, which may be fixed using staples along the outer edge to a 12 mm plywood base 45. This underlay acts the same as a hook and loop fastener (i.e. Velcro®) so effects pedals 52 can have the corresponding hook and loop fastener fixed to the top surface 45 thereby providing a strong, yet removable coupling means to affix the effects pedals 52 to the pedal board 1. Covering the base 45 with top surface 44 provides the musician freedom to configure the effects pedals 52 best suited to their individual needs.

In another embodiment, the top surface 44 may be removably mounted to the underside of the pedal board 1 with screws, rivets, or the like so that the top edges 48 are situated on top. To make it simpler to carry and transport the pedal board 1, handles 51 may be included and may also function as fastening points for the top surface 44 to the base 45. Along the back edge (i.e., the side facing the musician) a 20 mm right angle bracket 46 may be affixed to the base 45 using a single mounting screw 49. Attached to and distributed evenly across the bottom of the front base edge 46 and back edge 47, may be mounting feet (not shown), which can be made of rubber or equivalent material. Located in the upper left hand corner of the top surface 44 may be at least one input socket 43 for use with a USB device such as a light (not shown). The socket 43 may be a USB connector. Power for the USB device may be drawn from a power socket 42 (which may be a 3.5 mm mini-connector) located on the front station 30. The pedal board 1 may include a mini-to-standard USB cable 50 between the front station 30 and the input socket 43. In another embodiment, an instrument in-lead 87 may be connected using an instrument in-socket 89, which may be a standard 6.5 mm audio socket. The socket 89 may be used in pedal board 1 embodiments in which there is no wireless receiver 102 or in instances where all effects pedals 52 are exclusively used through the effects send and return loop.

FIG. 4B is a rear perspective view of FIG. 4A with the top surface 44 and base 45 removed. Sockets 21,22,23,25,27, 28,32 are more clearly illustrated and comprise power sockets 32, audio signal sockets 21,22,23,27,28, MIDI signal socket 25, the power socket 42, the mini-to-standard USB connection cable 50, and the input socket 43.

Figure 5:
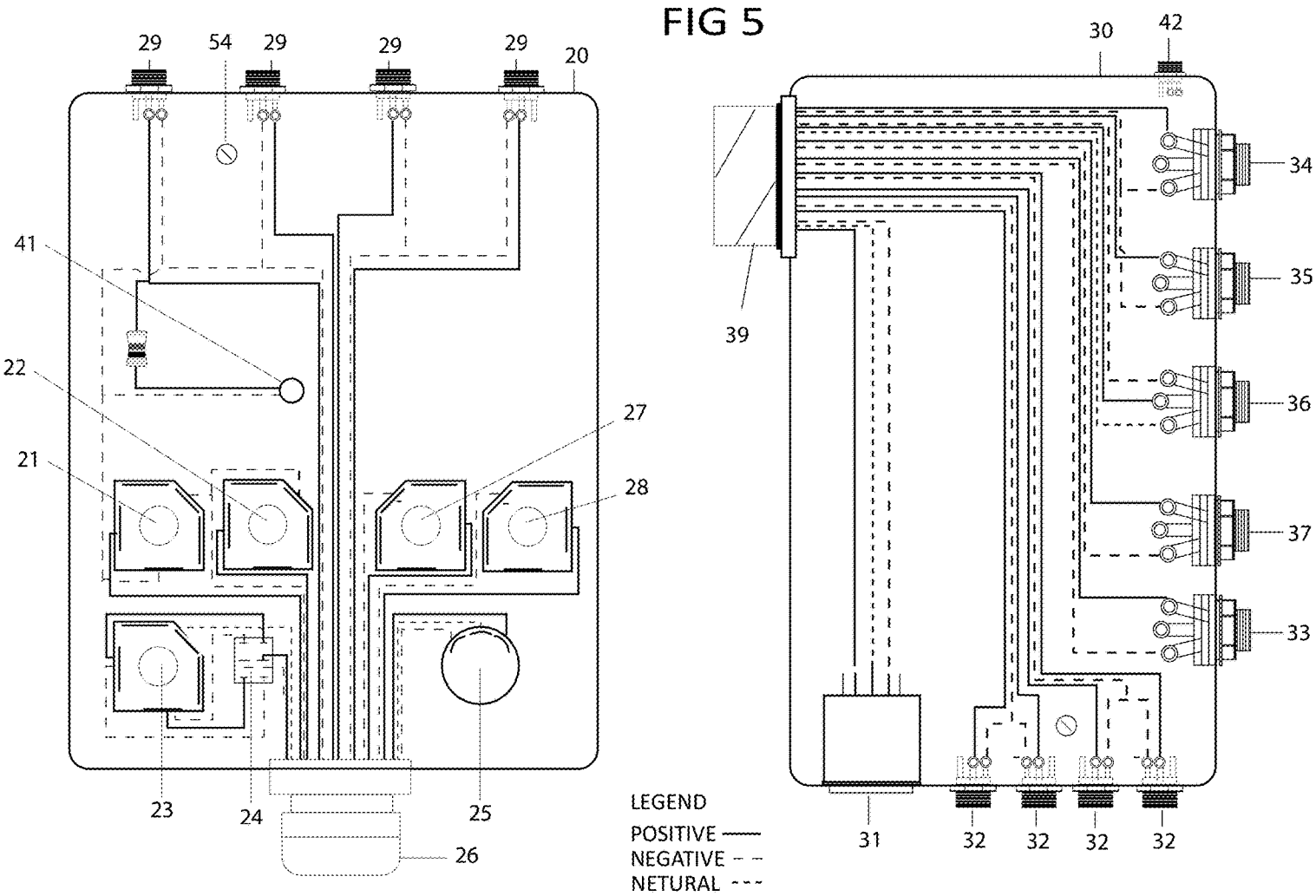
FIG. 5 is a wiring diagram of an embodiment device without an interconnection.

FIG. 5 is a wiring diagram of an embodiment device without an interconnection. In an embodiment, the front station 30 and back station 20 are similar in most respects except that sometimes a footswitch polarity selector switch 24 may only be located on the front station 30 and a cable gland 26 may comprise the back station connector. In another embodiment, there are eight (8) wire-pairs or "cores" within the cable 101, wherein each core may be comprised of two individually jacketed conductors and a drain wire encased in a shield, thus providing a total of twenty four (24) connections resulting in sixteen (16) individual conductors and eight (8) drain conductors, where each core is individually shielded. The group of entire eight (8) cores may also be further wrapped in an outer shield for further shielding from outside interference. The eight (8) cores, whether or not an outer shield is present, may be all wrapped with an outer jacket such as PVC. Some conductors may carry stereo signals (balanced), some mono signals (unbalanced), and some power. Mono connections may include the effects loop send sockets 27,37, effects loop return sockets 28,33, instrument in-socket 21,34, and instrument out sockets 22,35. Power connections may include all of the back station DC power sockets 29, and the front station power sockets 32. The amplifier footswitch sockets 23,36 may be a stereo connection located on the front station 30 and the back station, and the MIDI sockets 25,31 may be located on the front station 30 and back station 20. The back station 20 may have a ground point 54 for reducing noise (signal ground), increasing safety (power ground), and so forth. The ground point 54 may be connected to earth ground. Located at the top of the front station 30 may be the 3.5 mm mini-connector low power and digital signal output socket 42. Power may be available from the front station 30 to the USB device (not shown) but only when power is supplied to the back station 20 through any of the power input sockets 29.

Figure 6:
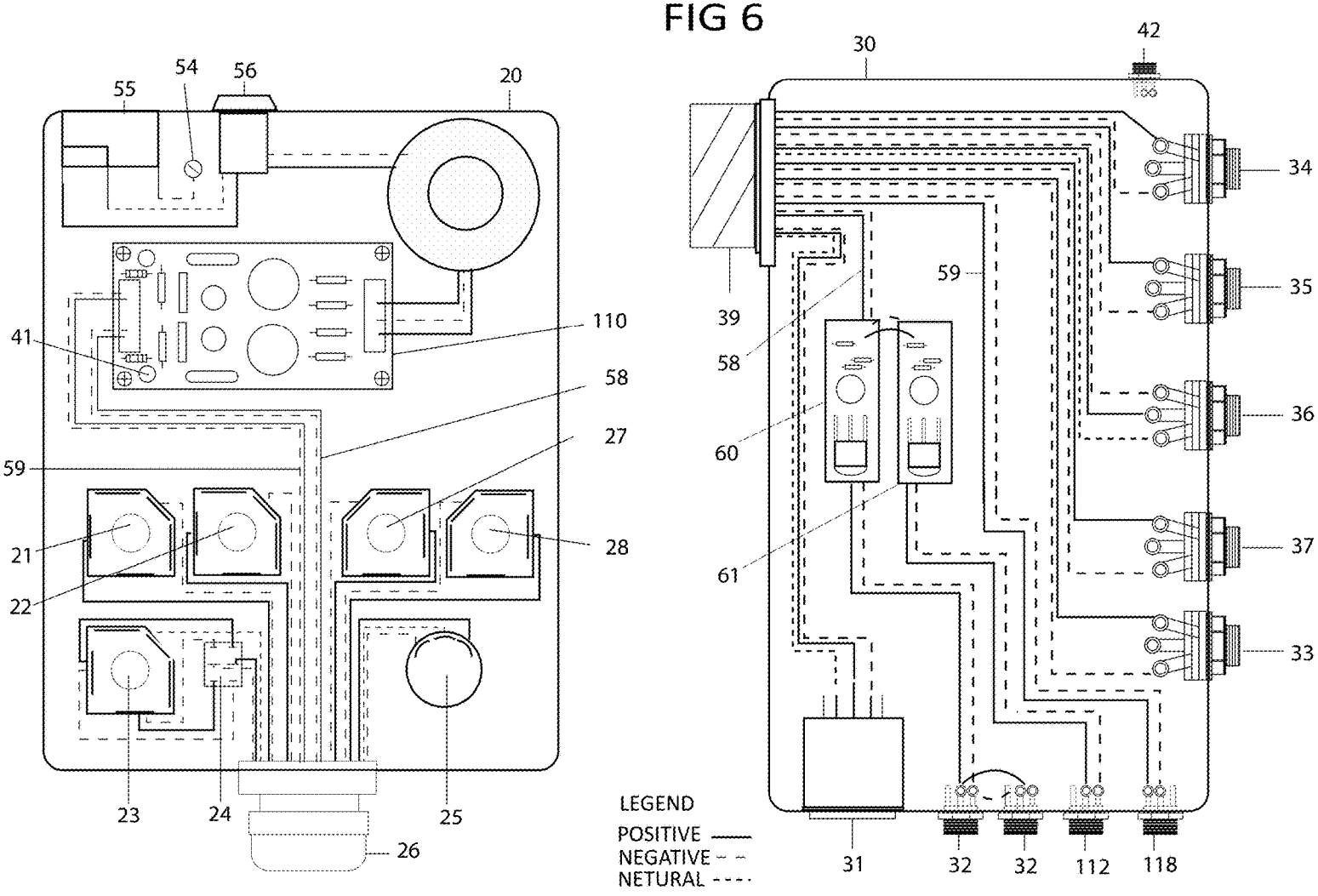
FIG. 6 is a wiring diagram of still another embodiment device without an interconnection.

FIG. 6 is a wiring diagram of still another embodiment device without an interconnection. In an embodiment, the back station 20 may include an internal power supply comprising a toroidal-type multi-tap transformer 57 and a universal power regulator 110. The transformer 57 may receive 220 VAC/50 Hz or 120 VAC/60 Hz power from main power source 80 through the input socket 55 located on the back station 20. A transformer may provide two individual AC power output leads (or "taps") that supply low voltage AC power (in this example each tap provides 24 VAC at 1.5 amps). These leads are connected to the Universal power regulator 110, which converts the low voltage AC power to low voltage DC power that is further regulated to provide DC voltage on power output leads 58,59. DC voltage level supplied on the output leads 58,59 may be any level at or greater than the needs of the front station 30 effects. For example, each output may be 18 VDC because the front station 30 effects may require 9 VDC or 12 VDC. The universal power regulator 110 may also contain an LED indicator 41. The power output leads 58,59 are provided to the front station 30 via the cable 101 which may be connected to the back station 20 via the cable gland 26.

In an embodiment, the output lead 58 may be split from the aggregate connector 39 and then connected to one or more power conditioning circuits 60,61 located within the front station 30. Similarly, power output lead 59 may be connected directly to a power output socket 118 in order to provide auxiliary power. In an embodiment, with a regulated output at 18 VDC, the front station 30 can provide enough power to provide a variable number of output sockets 118 with each output socket 118 capable of powering multiple pedals 52. The power conditioning circuits 60,61 may lower the voltage from a higher voltage received from the universal power regulator 110, such as 18 VDC, to a lower voltage level. The conditioning circuits 60, 61 may also convert AC to DC and regulate the output power. The conditioning circuits 60, 61 may provide a selectable voltage output whereby the user can further modify, via a switch or through a programmable interface such as FPGA, the voltage supplied to the effects sockets 71-76. For example, circuit 60 may provide 9 VDC and circuit 61 may provide 12 VDC, but other combinations may be embodied such as both circuits 60, 61 provide the same voltage such as 9 VDC.

The front station 30 may accommodate various types of power regulators. For outputting regulated power at a more typical DC voltage of 9 VDC, the front station 30 may use a fixed voltage regulator. Alternately, to accommodate other not-so-typical DC voltages, such as 12 VDC or 18 VDC, the front station 30 may use a variable voltage regulator. From any of the one or more conditioning circuits 60,61, the front station 30 can provide enough power to connect up multiple power output sockets 32 with each output socket 32 capable of powering multiple pedals.

In an embodiment, the back station 20 may have a fuse 56 to protect the transformer 57 from potential power spikes. The back station 20 may be earth grounded at the ground terminal 54. In the front station 30, the output power socket 42 for an external LED is provided from the power conditioning circuit board 60,61.

Figure 7A:
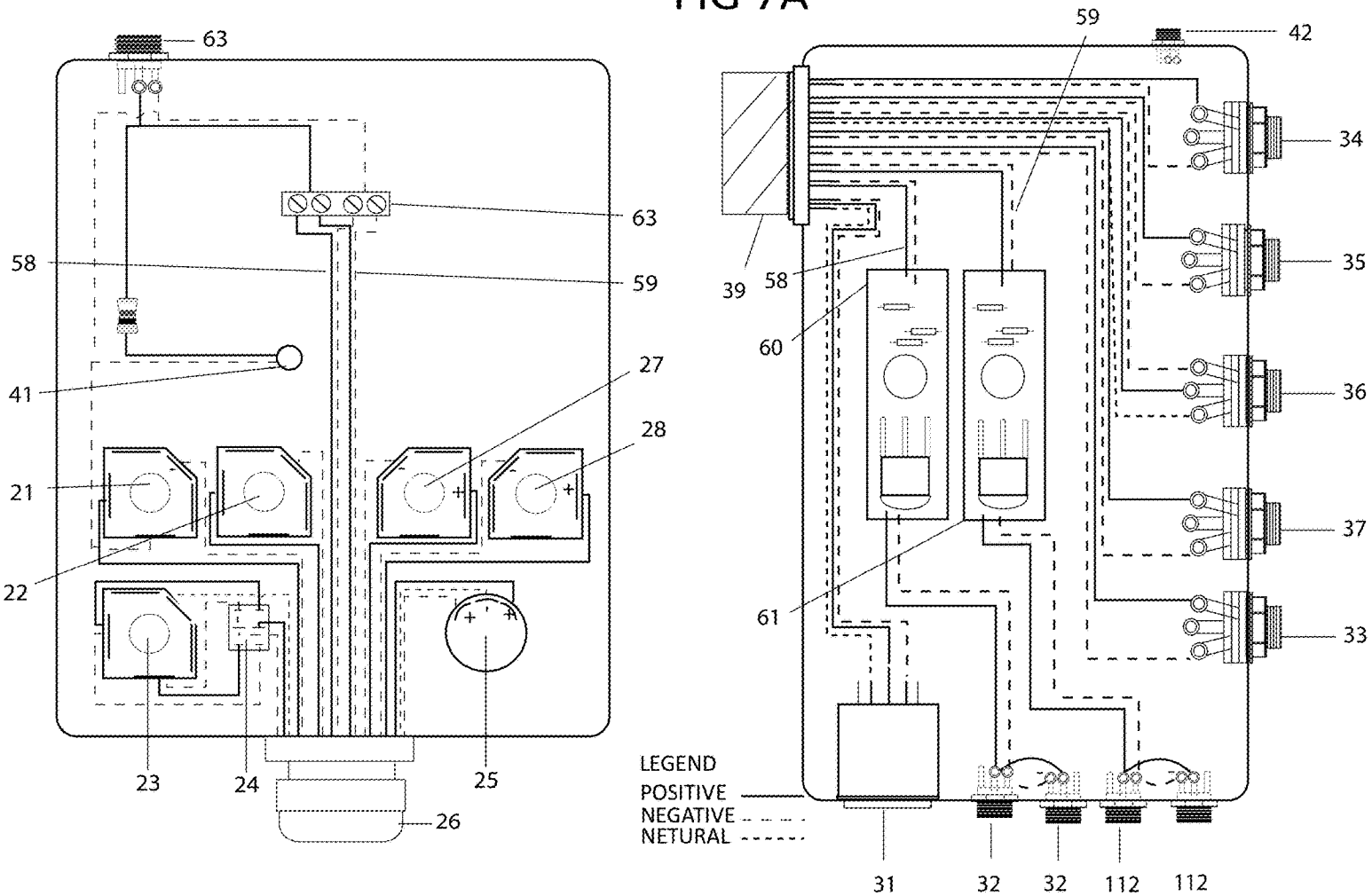
FIG. 7A is a wiring diagram of yet another embodiment device without an interconnection.

FIG. 7A is a wiring diagram of yet another embodiment device without an interconnection. In an embodiment, the back station 20 may comprise an input socket 63 to accept DC voltage instead of AC voltage. DC input voltage may be supplied by a single external transformer (not shown) that comprises an AC/DC converter. The transformer (not shown) may supply a single DC voltage, such as 24 Volt at 5 Amps, to the back station 20 via the power input socket 63, which may be a standard 2.1 mm socket. Input power may then be split using a two-in-four-out terminal block. Power output lead 58,59 may then carry the DC voltage to the front station 30.

Figure 7B:
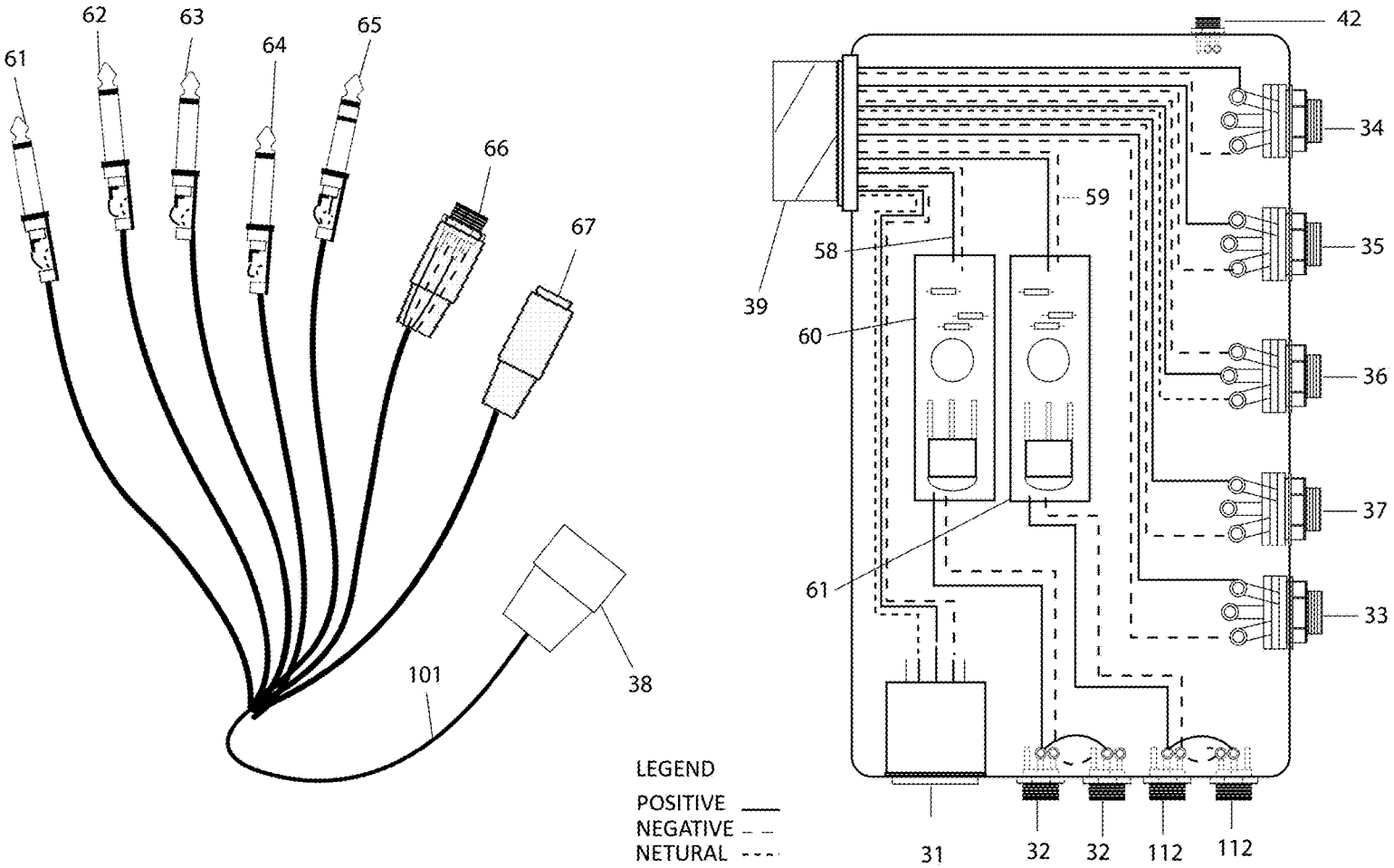
FIG. 7B is a wiring diagram of an embodiment device shown in FIG. 3A.

FIG. 7B is a wiring diagram of an embodiment device shown in FIG. 3A. In an embodiment, the back station 20 may not be used. Individual plugs 61-67 connect the front station 30 to the back stage equipment via the cable 101.

Figure 8:
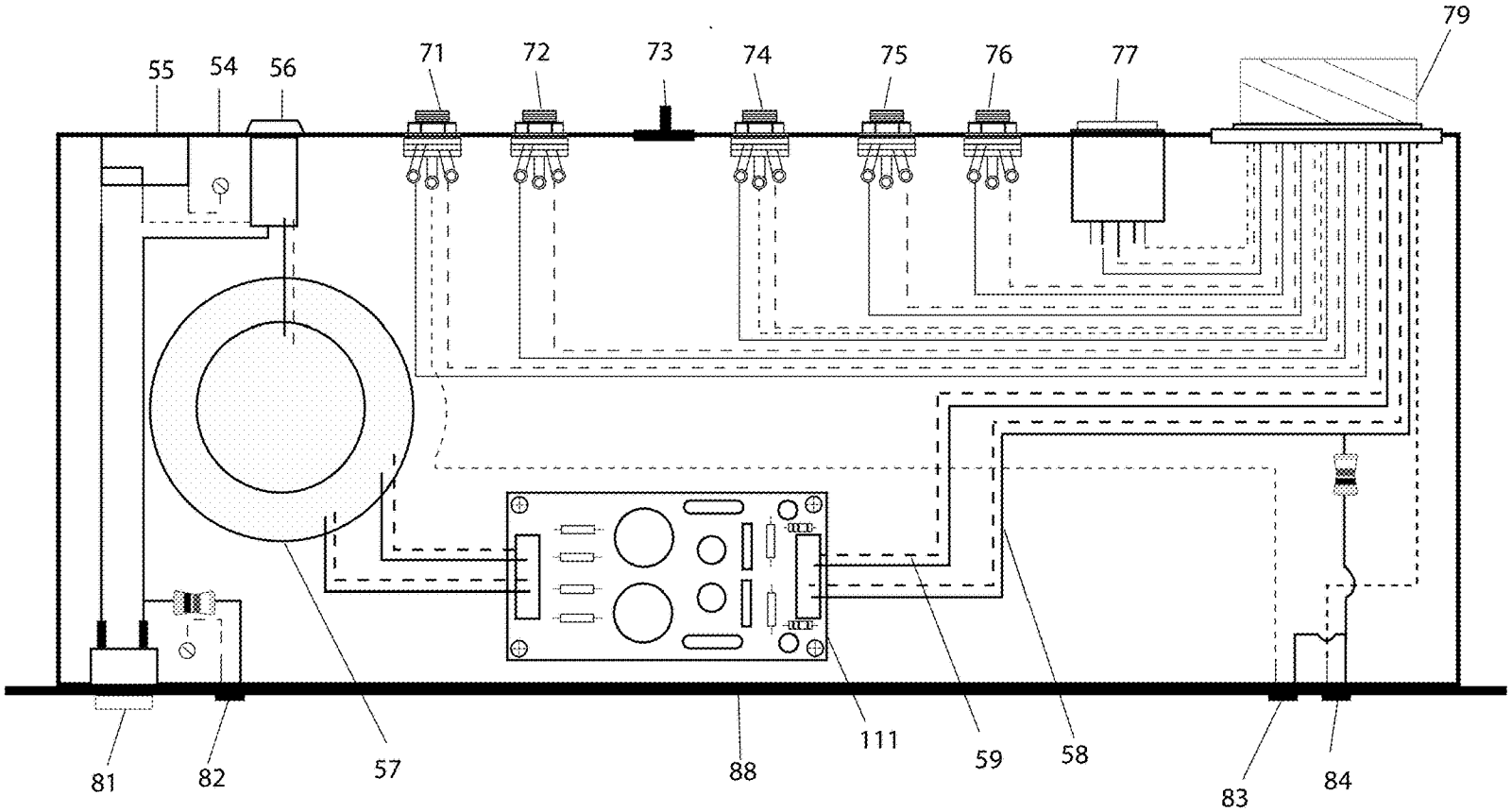
FIG. 8 is a wiring diagram of an embodiment device shown in FIG. 3B.

FIG. 8 is a wiring diagram of an embodiment device shown in FIG. 3B. The wiring diagram depicts on the back station 88. In an embodiment, power input to the back station 88 may be 220 VAC/50 Hz or 120 VAC/60 Hz as previously described herein. Power may be received through the power input 55. Input AC power may be converted to DC power for use at the front station 30 using an AC/DC power supply 111, which may use a transformer 57. The signal inputs 71-77 may be positioned on the rear panel, which may leave the front panel with a power switch 81, a power indicator LED 82, and other status indicator LEDs 83,84 for verifying connectivity of the cable 101 and the amplifier signal input 71. Upon connecting the cable 101 to the back station 20 and front station 30, the power input socket 55 and all signal input sockets 71-77 become immediately operational.

Figure 9:
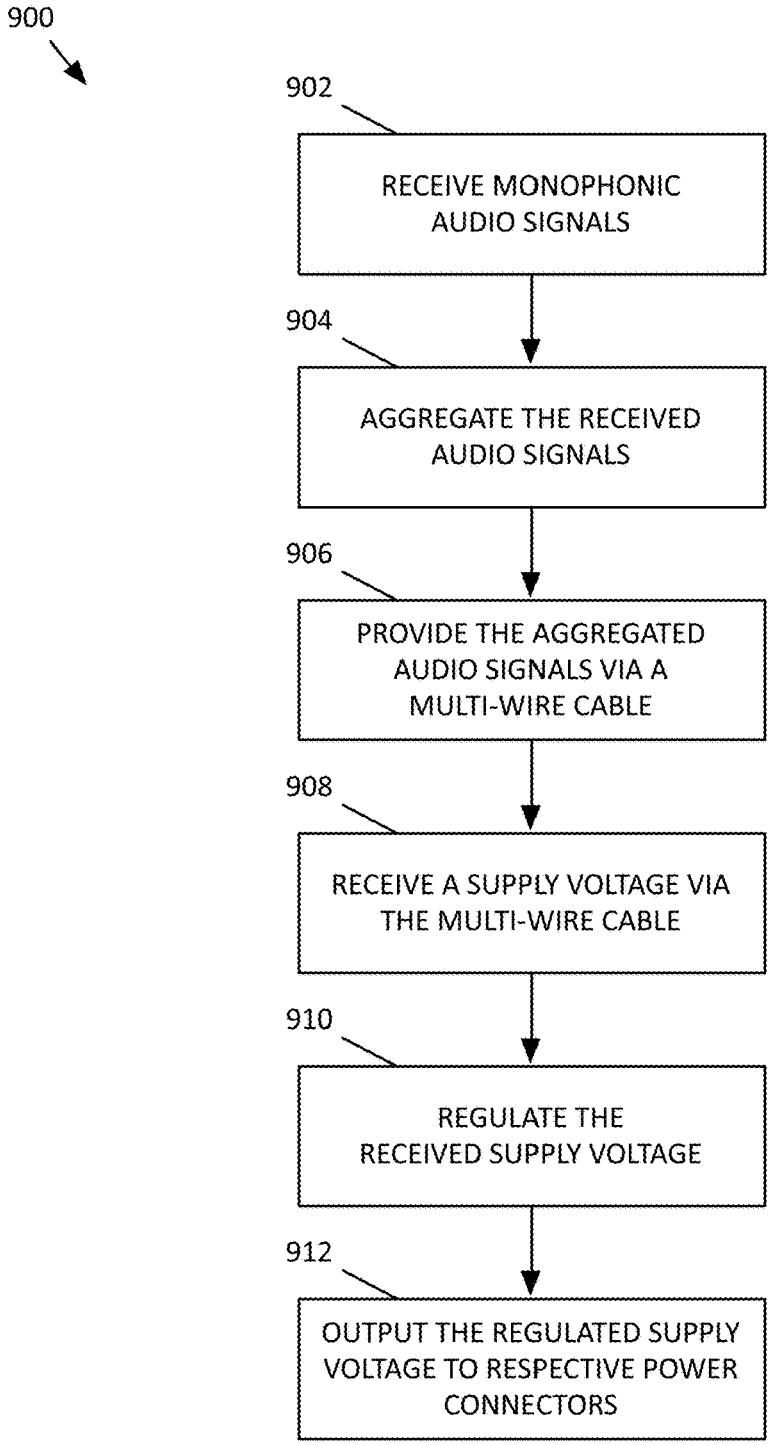
FIG. 9 is a flow chart of an embodiment method of aggregating audio signals.

FIG. 9 is a flowchart of a method, in accordance with various embodiments. Though the method is described as being carried out by pedal board 1, those having skill in the art will appreciate that other devices or components may be used to carry out the method.

As shown, method 900 begins at step 902 with pedal board 1 receiving one or more monophonic audio signals from respective monophonic-audio-signal connectors via respective monophonic-audio-signal conductors. The monophonic-audio-signal connectors could take the form of (or include) monophonic audio signal input sockets 33, 34, 35, and/or 37, and the monophonic-audio-signal conductors could take the form of (or include) one or more signal leads 11 through 16. The monophonic-audio-signal connectors and the monophonic-audio-signal conductors could take other forms as well.

At step 904, pedal board 1 aggregates the one or more monophonic audio signals into respective wire groups of a multi-wire cable, and at step 906, pedal board 1 provides the aggregated monophonic audio signals to a back station via the multi-wire cable. The multi-wire cable could take the form of (or include) multi-conductor cable 101, and the back station could take the form of (or include) back station 88. Those of skill in the art will appreciate that the multi-wire cable and the back station could take other forms without departing from the scope of the claims.

In an embodiment, pedal board 1 additionally (i) receives one or more stereophonic audio signals from respective stereophonic-audio-signal connectors via respective stereophonic-audio-signal conductors, (ii) aggregates the one or more stereophonic audio signals into respective wire groups of the multi-wire cable, and (iii) provides the aggregated stereophonic audio signals to the back station via the multi-wire cable. The stereophonic-audio-signal connectors could take the form of (or include) stereo audio signal input sockets 36, among other possibilities.

At step 908, pedal board 1 receives at least one supply voltage from the back station via the multi-wire cable, and at step 910, pedal board 1 regulates the received at least one supply voltage. The supply voltage could take the form of (or include), for example, a direct-current supply voltage and/or an alternating-current supply voltage. The received supply voltage is regulated via a conditioning circuit. The conditioning circuit could take the form of (or include) one or more of power-conditioning circuits 60,61, among other examples.

At step 912, pedal board 1 outputs the regulated supply voltage to respective output power connectors. The output power connectors may take the form of (or include) power output sockets 32, 112, and/or 118. The output power connectors could take other forms as well.

It should be appreciated that the various embodiments described above describe the input power traveling through the multi-wire cable. However, it should be appreciated that embodiments are possible wherein the input power (and/or main power) is conducted through a separate cable or line and therefore not conducted through the multi-wire cable. Of course, there is no prohibition to having the power split between the multi-wire cable and a separate "cable," if so desired. Therefore, multiple various are contemplated herein, being with the scope and understanding of one of ordinary skill in the art.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A device for providing power and signal connection between a plurality of front and back sound stage music equipment, comprising:

a front stage housing, supporting connection to a plurality of music equipment and to an input power;

a first plurality of music equipment signal sockets disposed on an exterior of the front stage housing, the first plurality of music equipment signal sockets adapted to provide connection to front stage music equipment for an amplifier instrument-in signal, an instrument-in signal, and a foot switch signal;

at least one power connector disposed on the exterior of the front stage housing, adapted to provide the input power;

a first aggregate, multi-pin wiring connector having a cable side and front stage side, disposed on the exterior of the front stage housing, the front stage side of the first aggregate connector having a first plurality of electrical contacts interior to the front stage housing, designated for connection to the amplifier instrument-in signal, the instrument-in signal, the foot switch signal, and the input power, wherein the cable side of the first aggregate connector is adapted to be removably connected to a single, multi-conductor cable;

a single, power and signal conveying cable having a front stage end and a back stage end, the front stage end having a first connector adapted to removably mate to the first aggregate connector, wherein the cable contains one or more shielded multi-electrical conductors and is adapted to convey the amplifier instrument-in stage signal, instrument-in stage signal, the foot switch stage signal, and the power input; and at least one conditioning circuit having access to supplied power and providing the input power through the cable to the front stage music equipment, wherein the device enables power and signals between the front and back sound stage music equipment to be conveyed by a single cable.

2. The device of claim 1, wherein the first plurality of music equipment signal sockets is further adapted to provide connection to at least one of a MIDI signal and/or MIDI power, microphone signal, effects loop send and return signal, and a wireless signal.

3. The device of claim 1, further comprising a first plurality of plugs for the music equipment signal and the input power, terminating the back stage end of the cable and connected to the first plurality of electrical conductors, the plugs adapted to mate directly to respective back stage music equipment and wherein the input power is at least one of a power main AC, DC power, regulated DC power, and regulated AC power.

4. The device of claim 2, further comprising a first plurality of plugs for the music equipment signal and input power, terminating the back stage end of the cable and connected to the first plurality of electrical conductors, the plugs adapted to mate directly to respective back stage music equipment and wherein the input power is at least one of a power main AC, DC power, regulated DC power, and regulated AC power.

5. The device of claim 1, further comprising a second plurality of music equipment signal plugs, terminating the back stage end of the cable and connected to a second plurality of electrical conductors in the cable, the plugs adapted to mate directly to respective back stage music equipment.

6. The device of claim 2, further comprising a second plurality of music equipment signal plugs, terminating the back stage end of the cable and connected to a second plurality of electrical conductors in the single cable, the plugs adapted to mate directly to respective back stage music equipment.

7. The device of claim 1, further comprising a second aggregate, multi-pin wiring connector disposed on the exterior of the front stage housing, a front stage side of the second aggregate connector having a second plurality of electrical contacts interior to the front stage housing, designated for connection to a cable side of the second aggregate connector, wherein the front stage end of the cable has a second connector adapted to removably mate to the second aggregate connector.

8. The device of claim 2, further comprising a second aggregate, multi-pin wiring connector disposed on the exterior of the front stage housing, a front stage side of the second aggregate connector having a second plurality of electrical contacts interior to the front stage housing, designated for connection to a cable side of the second aggregate connector, wherein the front stage end of the cable has a second connector adapted to removably mate to the second aggregate connector.

9. The device of claim 1, further comprising a front stage pedal board station connected to the cable via the first aggregate connector, the pedal board station adapted to support a plurality of musical instrument effects pedals and having a flat cover disposed at a top end and removably coupled to a hollow enclosure, wherein stage signals and the power to the plurality of musical instrument effects pedals are provided via the single cable connection.

10. The device of claim 2, further comprising a front stage pedal board station connected to the cable via the first aggregate connector, the pedal board station adapted to support a plurality of musical instrument effects pedals and having a flat cover disposed at a top end and removably coupled to a hollow enclosure, wherein stage signals and the power to the plurality of musical instrument effects pedals are provided via the single cable connection.

11. The device of claim 7, further comprising a front stage pedal board station connected to the cable via at least one of the first and second aggregate connector, the pedal board station adapted to support a plurality of musical instrument effects pedals and having a flat cover disposed at a top end and removably coupled to a hollow enclosure, wherein stage signals and the power to the plurality of musical instrument effects pedals are provided via the single cable connection.

12. The device of claim 8, further comprising a front stage pedal board station connected to the cable via at least one of the first and second aggregate connector, the pedal board station adapted to support a plurality of musical instrument effects pedals and having a flat cover disposed at a top end and removably coupled to a hollow enclosure, wherein stage signals and the power to the plurality of musical instrument effects pedals are provided via the single cable connection.

13. The device of claim 1, wherein the first plurality of music equipment signal sockets convey at least one of a stereophonic electrical signal, monophonic electrical signal, —stage signal from a wireless receiver, USB signal, and USB power.

14. The device of claim 1, wherein the back stage end of the cable has a single connector adapted to mate to another aggregate, multi-pin wiring connector having a back stage side and a cable side, disposed on the exterior of a back stage housing, the back stage side of the another aggregate connector having another plurality of electrical contacts interior to the back stage housing, designated for connection to the amplifier instrument-in signal, the instrument-in signal, and the foot switch signal.

15. The device of claim 2, wherein the back stage end of the cable has a single connector adapted to mate to another aggregate, multi-pin wiring connector having a back stage side and a cable side, disposed on the exterior of a back stage housing, the back stage side of the another aggregate connector having another plurality of electrical contacts interior to the back stage housing, designated for connection to the amplifier instrument-in signal, the instrument-in signal, and the foot switch signal.

16. The device of claim 1, wherein one or more of the signals is in a digital format.

17. The device of claim 2, wherein one or more of the signals is in a digital format.

18. The device of claim 1, wherein power for the input power is provided through a separate line, independent from the single cable.

19. A single cable method for providing power and signal connection between a plurality of front and back sound stage music equipment, comprising:

forming a front stage housing, supporting signal and power connection to a plurality of sound stage music equipment;

disposing at least one plurality of signal sockets on an exterior of the front stage housing for connection to the plurality of sound stage music equipment, the at least one plurality of signal sockets adapted to provide connection to front stage music equipment for one or more amplifier instrument-in signals, one or more instrument-in signals, and a one or more foot switch signals;

disposing at least one power socket on the exterior of the housing, adapted to provide input power;

disposing at least one aggregate, multi-pin wiring connector, having a cable side and front stage side, onto the exterior of the front stage housing, the front stage side of the at least one aggregate connector having a plurality of electrical contacts interior to the front stage housing, designated for connection to the one or more amplifier instrument-in signals, one or more instrument-in signals, one or more foot switch signals, and to the input power, wherein the cable side of the at least one aggregate connector is adapted to be removably connected to a single shielded, multi-conductor cable;

connecting a single cable to the at least one aggregate connector, the cable having a front stage end and a back stage end, the front stage end having at least one connector adapted to removably mate the at least one aggregate connectors, wherein the cable contains shielded multi-electrical conductors for signal and power transmission; and providing at least one of a regulated DC power and regulated AC power through the cable to supply power to the front stage music equipment, wherein the method enables power and signals between the front and back sound stage music equipment to be conveyed by a single cable connection.

20. The method of claim 19, further comprising sending at least one of a MIDI signal, MIDI power, microphone signal, effects loop send and return signal, and a wireless signal through the cable via the music equipment signal sockets.

* * * * *